US005971457A

United States Patent [19]

Gallo, Jr.

[11] Patent Number: 5,971,457

[45] Date of Patent: Oct. 26, 1999

[54] BOXER-UTILITY VAULT BOX LIFTER

[76] Inventor: Angelo John Gallo, Jr., 34741 Acacia Ave., Yucaipa, Calif. 92399

[21] Appl. No.: 09/173,578

[22] Filed: Oct. 15, 1998

[51] Int. Cl.[6] ..... B66C 1/54

[52] U.S. Cl. ..... 294/97; 294/110.1

[58] Field of Search ..... 294/93–95, 97, 294/98, 110.1, 86.24; 269/46, 48.1, 238

[56] References Cited

U.S. PATENT DOCUMENTS

| | | | |
|---|---|---|---|
| 725,169 | 4/1903 | Stephens | 294/97 |
| 976,652 | 11/1910 | Hensley | 294/97 |
| 1,035,728 | 8/1912 | Peck | 294/97 |
| 1,186,351 | 6/1916 | Wallace | 294/86.24 |
| 1,413,780 | 4/1922 | Rauch | 294/97 |
| 1,813,600 | 7/1931 | Aubol . | |
| 1,817,869 | 8/1931 | Benton | 294/97 |
| 2,610,889 | 9/1952 | Penn . | |
| 2,794,669 | 6/1957 | Schardinger | 294/97 |
| 4,095,834 | 6/1978 | Strauss . | |
| 4,285,538 | 8/1981 | Luke . | |
| 4,474,400 | 10/1984 | Toffolon . | |
| 4,500,078 | 2/1985 | Brennan . | |

*Primary Examiner*—Dean J. Kramer

[57] ABSTRACT

An internal lifting device for precast concrete utility vault boxes having a multitude of configuring shapes, the device comprises a pair of forked shape lifting legs swingable between retracted and expanded positions. The legs being connected at a intermediate point to the ends of a spreader bar that provides horizontal adjustably. Sheave are mounted on the upper ends of the legs to aid a single flexible steel cable that forms a triangular configuration to a lifting attachment. The lower ends the legs having fixed shoes with outwardly projecting portions that engages the internal side surfaces of a utility vault box unit with the legs expanded, with the legs retracted the legs and shoes are freely moveable vertically between the sidewalls of the vault box unit. When upward force is applied to the lifting attachment the uppermost portions of the legs swing inwardly and the lowermost portions swing outwardly to engage the internal side surfaces of the vault box unit, thus lifting and supporting the vault box and forming an A-shape configuration in the expanded position. The device is particularly adapted for efficient use with precast concrete utility vault box units, and provides for a rapid and efficient operation in the lifting and manipulating of the vault box units with a truck mounted crane.

17 Claims, 11 Drawing Sheets

BOXER-UTILITY VAULT BOX LIFTER

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO A MICROFICHE APPENDIX

"Not Applicable"

BACKGROUND—FIELD OF INVENTION

CLASS 294, HANDLING: HAND AND HOIST-LINE IMPLEMENTS

This invention relates to the Public Utility Industry, specifically to an improved material handling device for concrete utility vault box units, formerly manipulate by hand.

BACKGROUND—DESCRIPTION OF PRIOR ART

Brennan shows a chimney flute insertion apparatus, the device would not be suitable for the lifting of concrete utility vault boxes and it was not intended for such purpose.

Toffolon shows a device for lifting massive precast concrete wall units; due to it's limited range this device would not be appropriate for the lifting of utility vault box units.

Luke shows a device for installing flute lining in chimneys, this device as Brennan's would not be suitable for the lifting of concrete utility vault boxes.

Strauss shows a device for lifting cylinder structures of a predetermined diameter; this would not be a suitable device.

Penn shows a device for the lifting of tire molds, and molding flasks. Its limited range would not conform to the needs of utility vault boxes.

Aubol shows a device adapted to support a carcass of beef, and would not be a suitable device.

None of the prior art found in the patent search was intended or built to safely lift these concrete utility vault box units, they were not adapted for use in this field.

Precast concrete utility vault boxes are frequently handled by hand, many workers having electric cranes equipped with their trucks use chains or clamps attached to these boxes to lift and manipulate them.

However, these methods were not only awkward and inconvenient but dangerous as well.

Manually lifting these utility vault boxes is not only physically strenuous, but the risk of injury to a workers upper extremity and low back presents the need for a safer way to a accomplish this task.

OBJECTS AND ADVANTAGES

Accordingly, several objects and advantages of my invention is, to find a safer way for a worker to lift and manipulate heavy concrete utility vault boxes without manually lifting these boxes by hand, risking injuries.

1. To addresses the issue of upper extremity shoulder, arm, and low back injuries caused by manually lifting and manipulating 50 to 250 lb. Utility vault box units.

2. To provide a safe reliable and easier method than with chains or clamps.

3. To eliminate frontal bending during vault box manipulation.

4. To provide a lifting concept that permits rapid and easy vault box manipulation.

5. To substantially reduce injuries, increase productivity and safety.

6. To provide a device that is lightweight, simple, and easy to use.

7. The prototyped was tested lifting over 600 lb.

8. To provide a device that can be made on any scale.

9. To provide a device that is adjustable to fit.

10. To provide a device that is easily dissembled for compact storage.

Still further objects and advantages will become apparent from a consideration of the ensuing description and accompanying drawings.

BRIEF SUMMARY OF THE INVENTION

In fulfillment of the foregoing object and in accordance with the present invention, a lifting device is provided and it is particularly adapted to precast concrete utility vault box units having a multitude of square, round, or rectangle shapes.

The lifting device is adapted to lift, manipulate, and efficiently deposit the vault units. As, for example from a warehouse storage yard, to the bed of a truck for installation in the field.

As well as, for removing and replacing from said field.

The device enters the unit vertically between the inner walls of the unit in a retracted position, and upon expansion and engagement with side surfaces of vault box, the lifting device serves to secure and balanced a unit for vertical and other movement.

Said device comprising:

A pair of pivotally connected lifting legs swingable between retracted and expanded positions, lower end portions of said legs having an overall horizontal dimension such that said legs can freely pass vertically between the sides of a precast concrete vault box unit, respectively in close proximity to the inner walls of said unit.

At least one pair of shoes respectively mountable on lower end portions of said legs and, having opposing laterally outward projecting portions adapted respectively to engage side surfaces of the precast concrete vault box unit with the legs of the lifting device in the expanded position.

A spreader element to which said lifting legs at a central point are pivotally attached at distal ends of said spreader element, and to provide a means for horizontal adjustability.

A pair of sheaves mounted at upper ends of said lifting legs facilitates a steel cable engaged to said sheaves with ends coupled to a lifting attachment forming a triangular configuration.

Said lifting attachment for securing a vertically movable hoist to the lifting device for lifting and manipulating precast concrete vault box units with the device.

Also some examples of the typical bolt-on 41, and pivotal 47 shoes that can be adapted.

Figure 11:
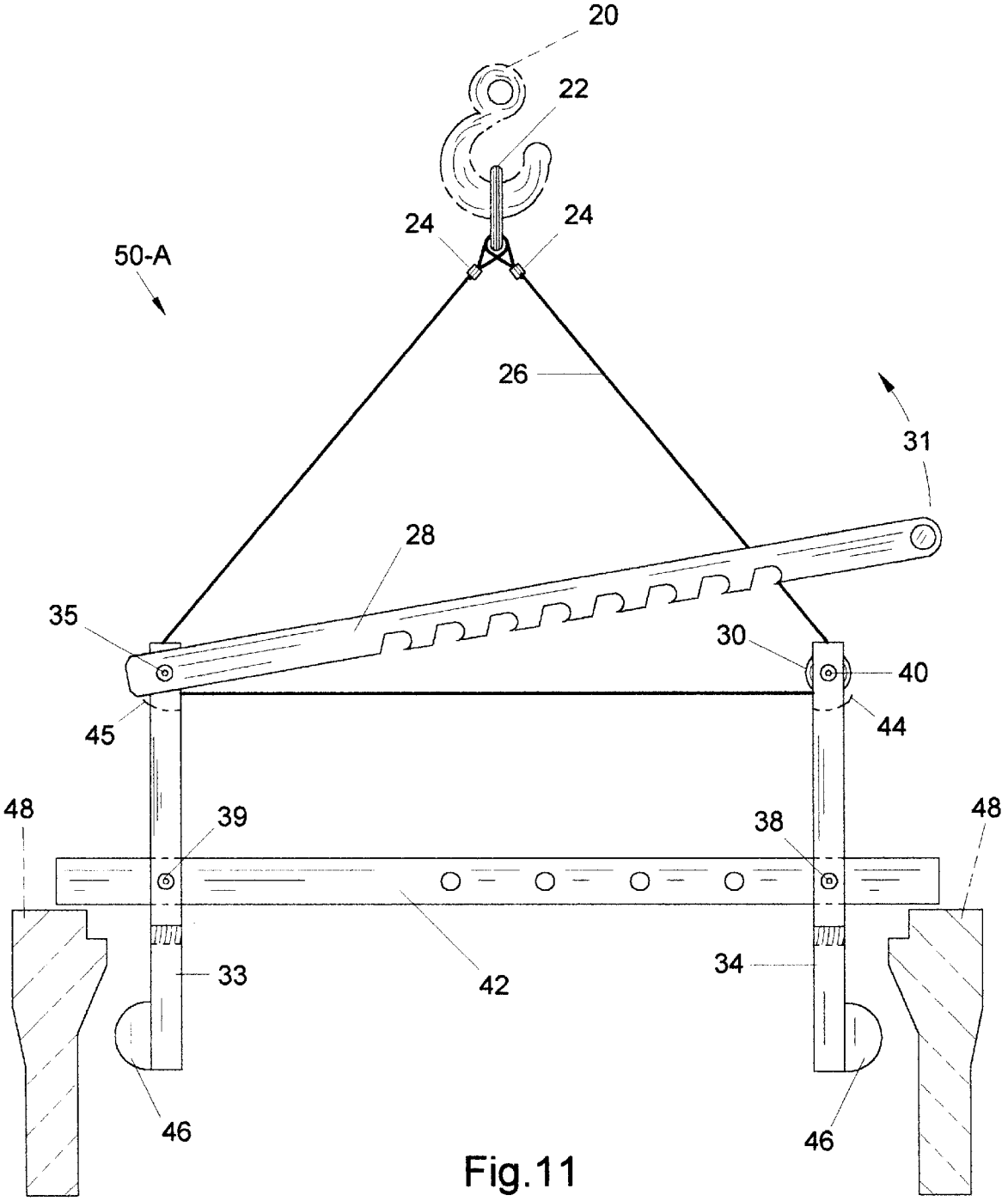

FIG. 11 Is a side view of the lifting device of the present invention 50-A with optional locking arm 28, in a lifted position 31.

Figure 12:
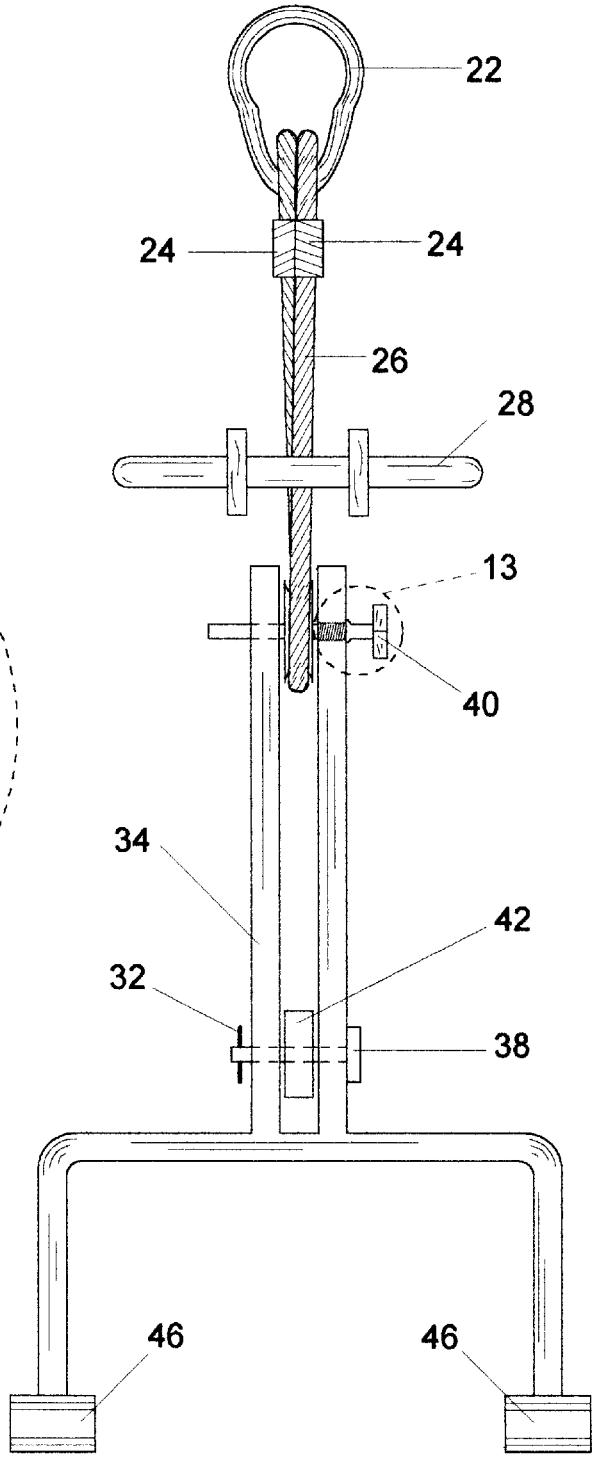

FIG. 12 Is a right end view of the lifting device of the present invention 50-A with optional locking arm 28 in a lifted position 49, also "special pin-bolt" 40 can be easily seen.

Figure 13:
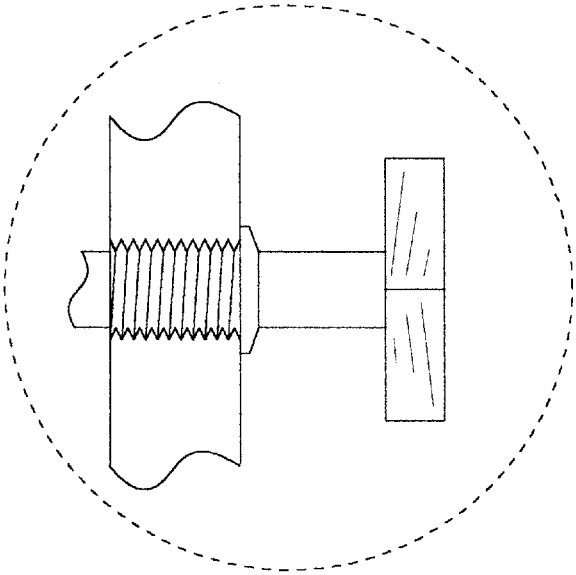

FIG. 13 Is an exploded view of "special pin-bolt" 40 required for locking arm 28.

Figure 14:
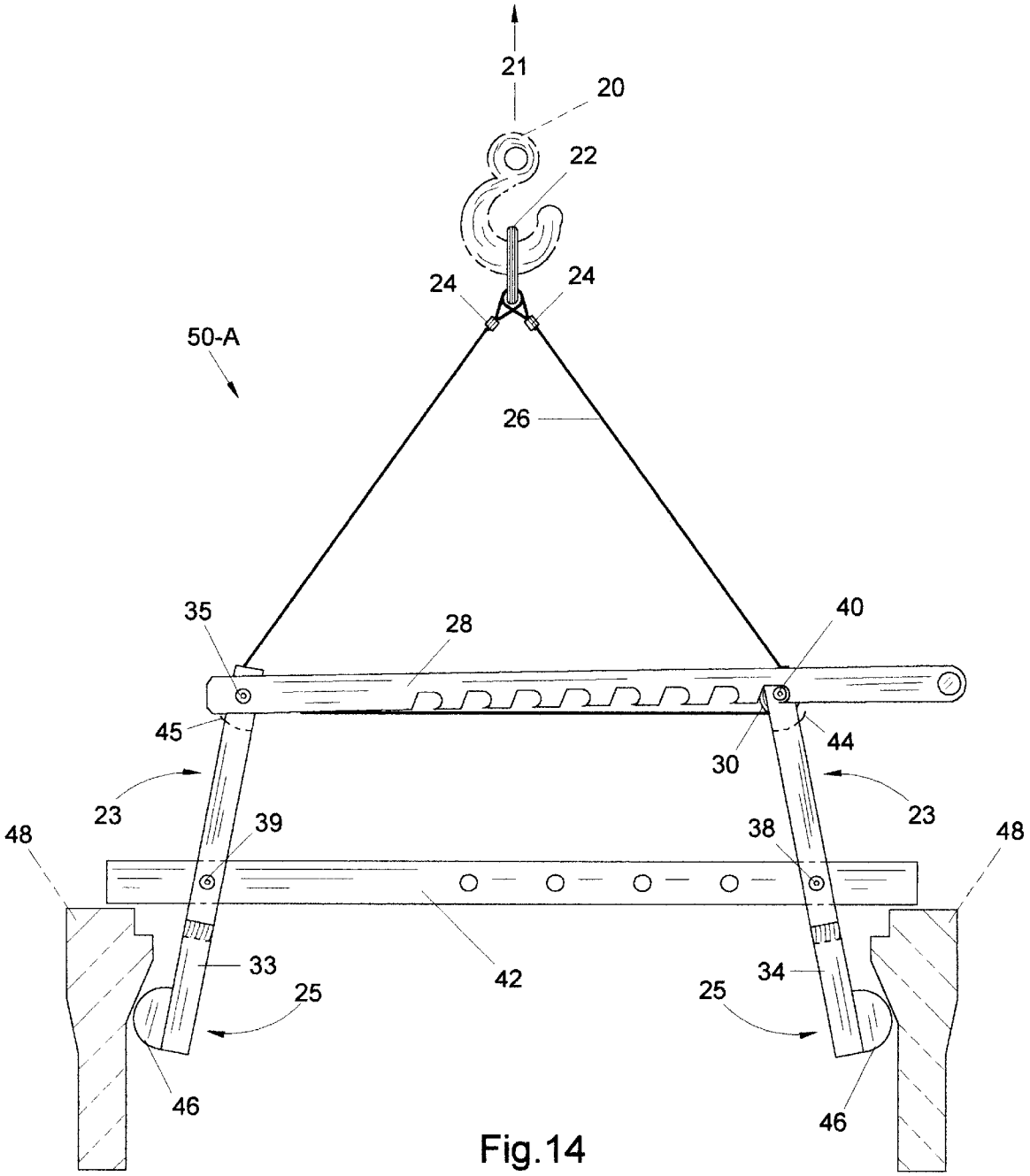

FIG. 14 Is a side view of the lifting device of the present invention 50-A shown in engagement with and supporting a utility vault box unit 48, with the locking arm 28, in the locked position.

Figure 15:
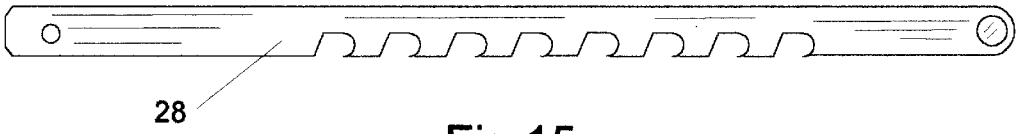

FIG. 15 Shows a side view of locking arm 28.

Figure 16:
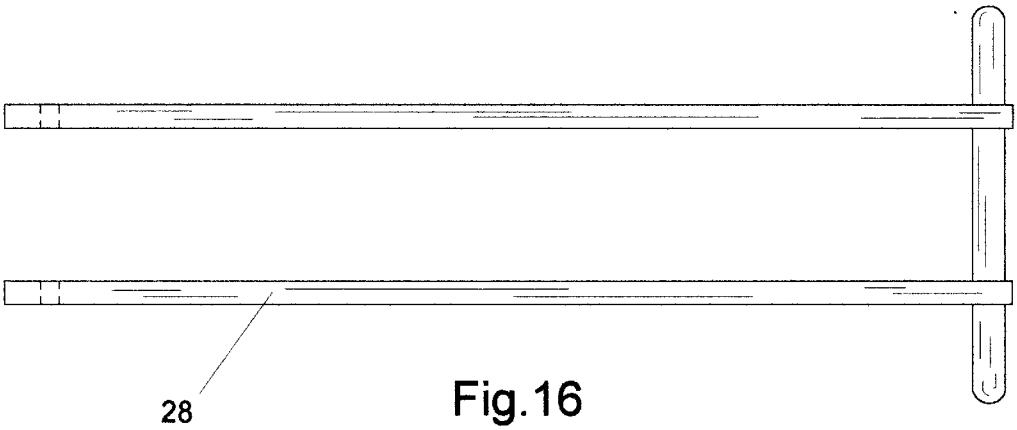

FIG. 16 Shows a top view of locking arm 28.

Figure 17:
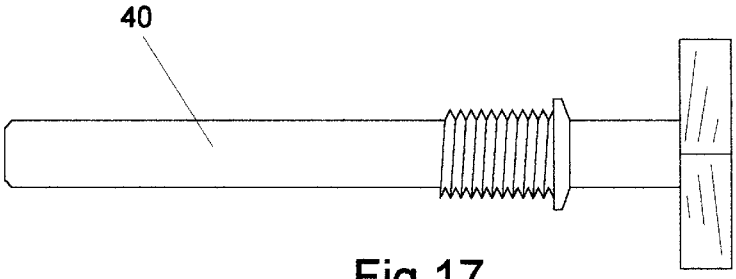

FIG. 17 Shows a side view of "special pin-bolt" 40 needed for locking arm 28.

Figure 18:
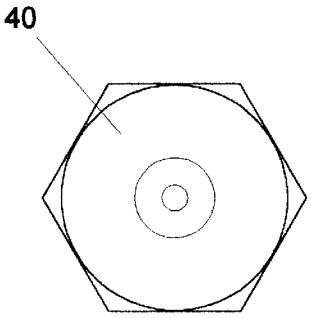

FIG. 18 Is a bolt side end view of "special pin-bolt" 23 of FIG. 17.

REFERENCE NUMERALS IN DRAWINGS

20 hook
22 lifting attachment
24 cable clamps
26 cable
28 locking arm
29 left sheave
30 right sheave
32 keeper clips
33 left lifting leg
34 right lifting leg
35 long pin
36 upper left pin
37 upper right pin
38 lower right pin
39 lower left pin
40 "special pin-bolt"
41 bolt-on shoes
42 adjustable spreader bar
43 bolt fastener
44 right cable guide
45 left cable guide
46 shoes
47 pivotal shoes
48 utility vault box unit
49 pivot pin
50 lifting device
50-A lifting device with locking mechanism

DETAILED DESCRIPTION OF THE INVENTION—FIGS. 1 TO 18

Figure 1:
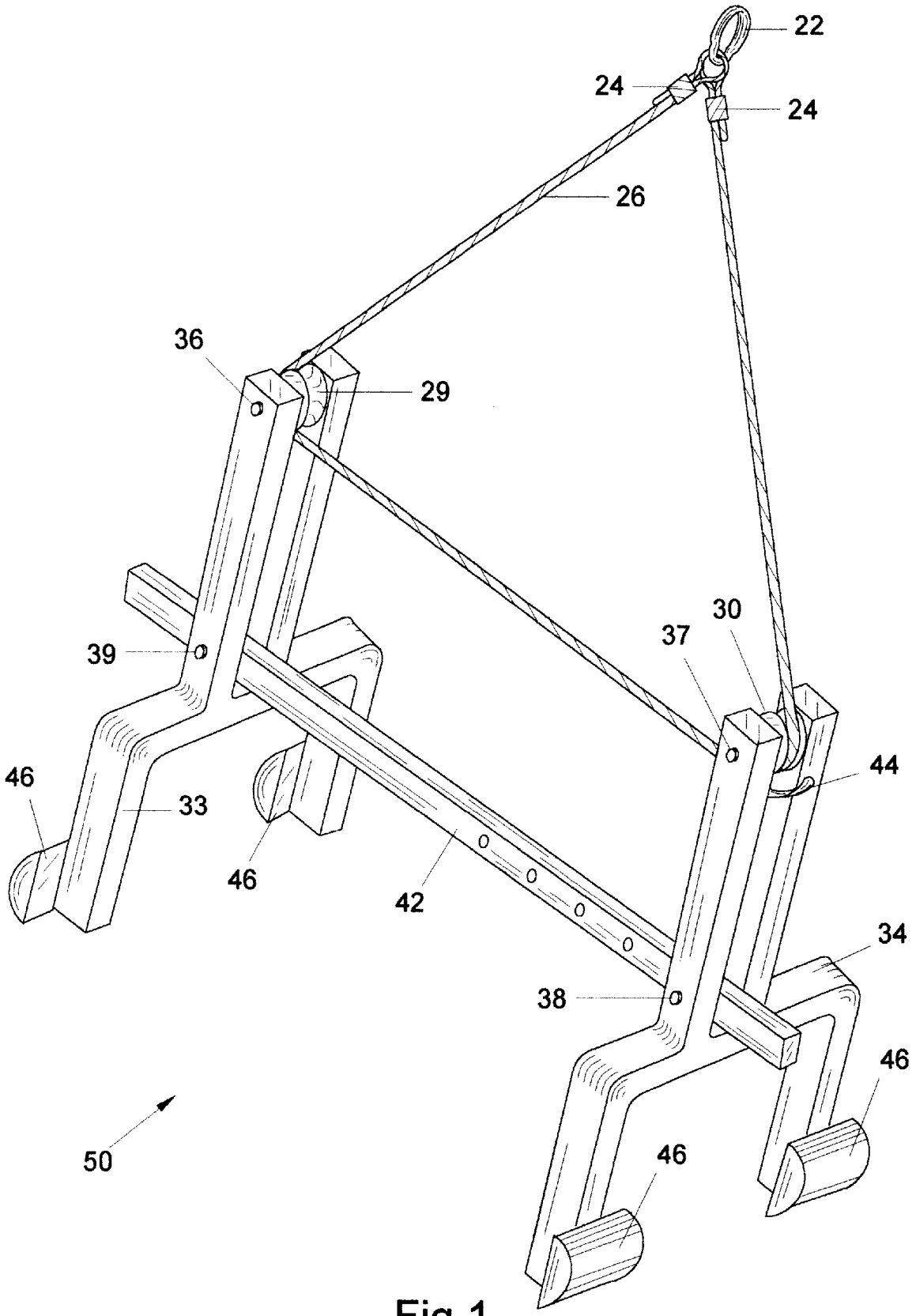
FIG. 1 Is a prospective view of the lifting device of the present invention 50 shown in a retracted position, the device is adjustable to accommodate different box sizes.
Figure 2:
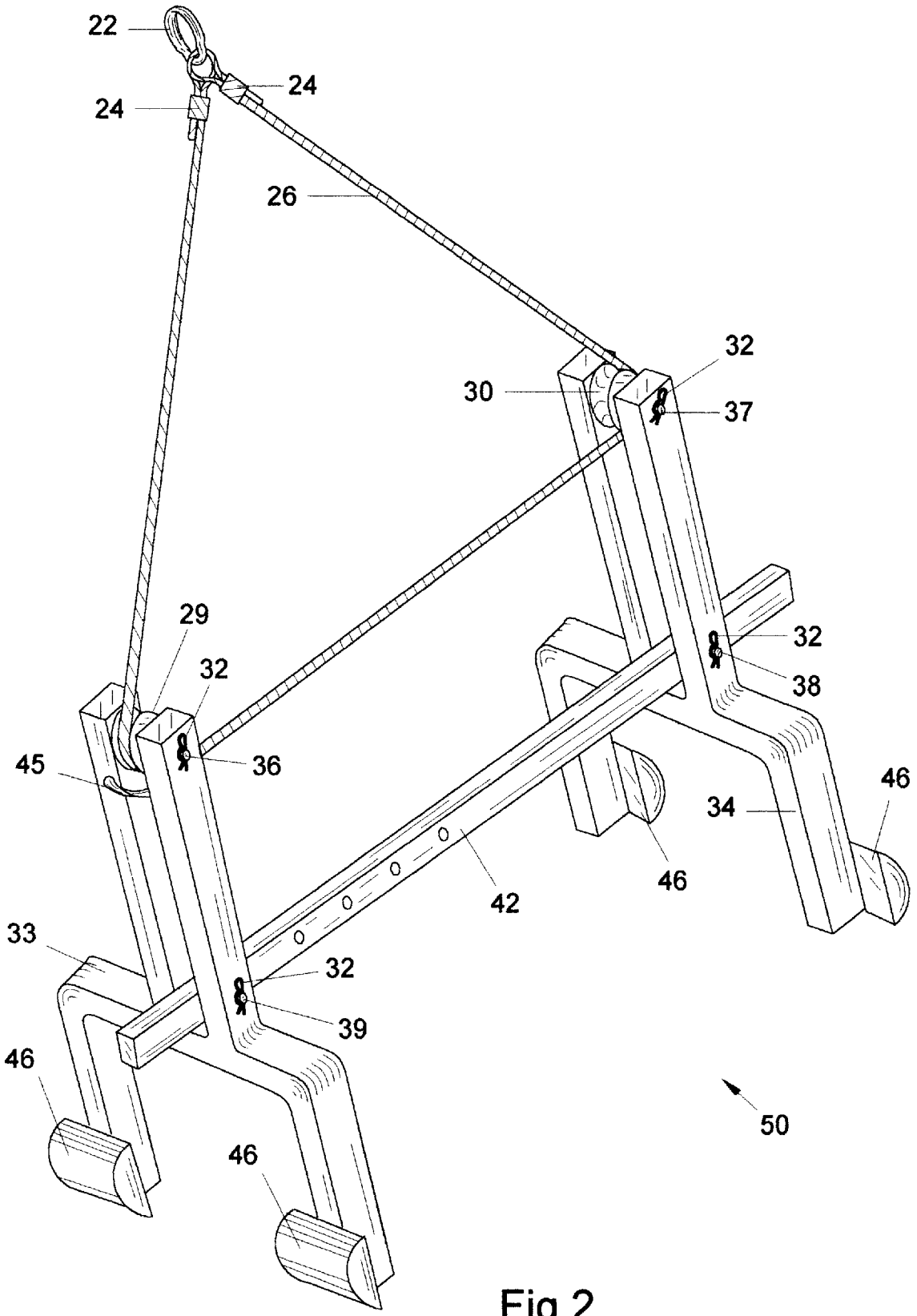
FIG. 2 Is a prospective view of the lifting device of the present invention 50 opposite to FIG. 1, shown to view keeper clips 32.

A prospective view of a lifting device constructed in accordance with the present invention and indicated generally at 50 in FIG. 1 and 2, includes a pair of similar pivotally connected lifting legs 33 and 34.

As illustrated, legs 33 and 34 are indirectly pivotally connected by lower pins 38 and 39 to an adjustable spreader bar 42.

Sheaves 29 and 30 are mounted to the top of legs 33 and 34 by upper pins 36 and 37 to facilitate cable 26 connected to lifting attachment 22 by cable clamps 24.

Figure 7:
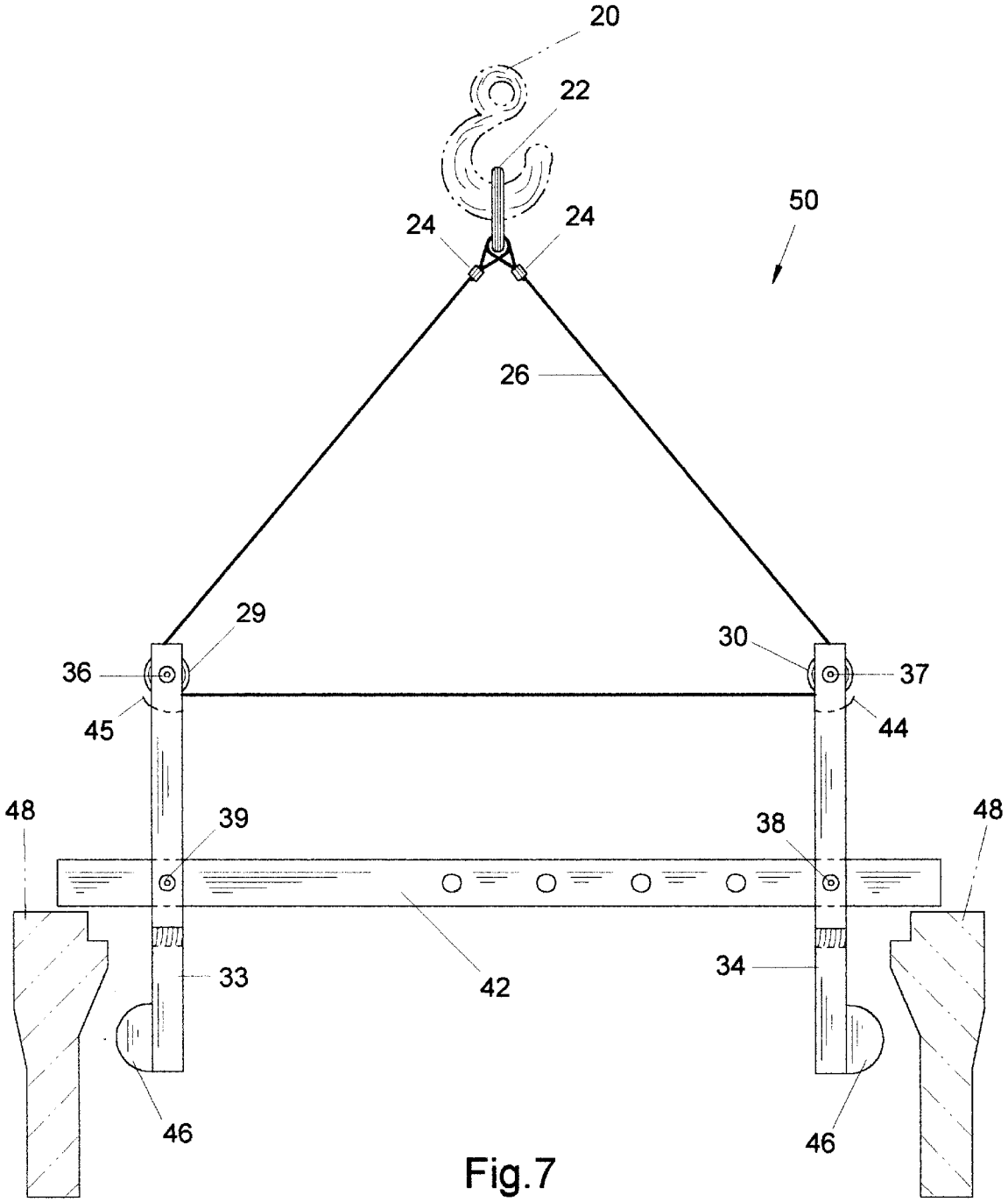
FIG. 7 Is a side view of the lifting device of the present invention 50 in a "at rest" position, lifting hook 20 and utility box 48 shown in phantom to illustrate their role.

A variety of hoists can thus readily connect to attachment 22 as for example hook 20 in FIG. 7. Which may depend on a truck mounted crane.

Cable guides 44 and 45 installed below sheaves 29 and 30 for retaining cable.

Shoes 46 have been permanently attached, though additional embodiments will include bolt-on and pivotal shoes to accommodate other lifting applications.

FIG. 2 shows a prospective view of the lifting device of the present invention 50 opposite to FIG. 1. Showing pins 36, 37, 38, and 39 held in place by keeper clips 32.

Figure 3:
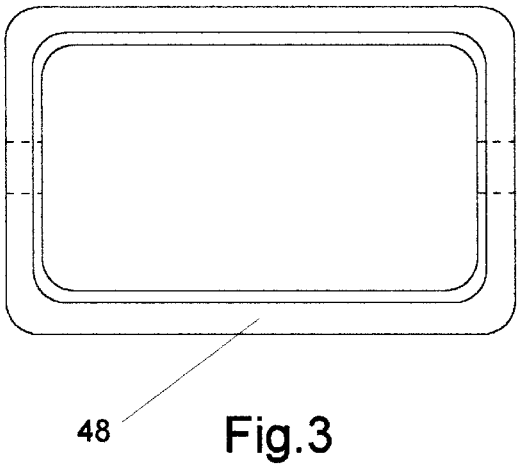
FIG. 3 Shows a top view of the typical precast concrete utility vault box unit 48.
Figure 4:
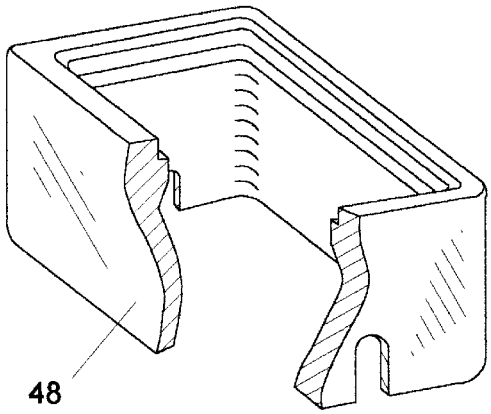
FIG. 4 Shows a perspective view of the typical concrete utility vault box unit 48 of the type handled by the lifting device of the present invention 50, with a portion cut away to show the internal structure.
Figure 5:
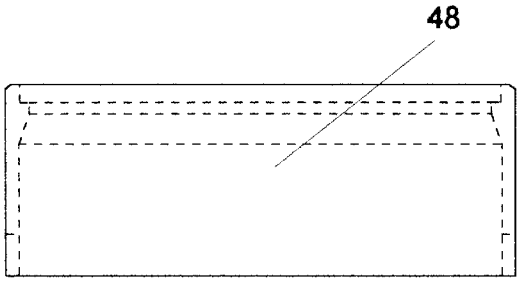
FIG. 5 Is a side view of the utility box 48.
Figure 6:
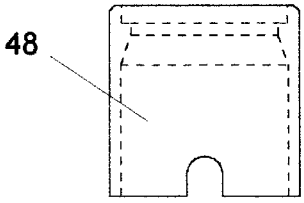
FIG. 6 Is an end view of the utility box 48.

FIG. 3, 4, 5, & 6 shows a typical precast concrete utility vault box unit 48 of the type handled by the lifting device of the present invention 50. At FIG. 4 showing a prospective view with a section cut away to illustrate the internal structure of unit 48.

FIG. 7 provides a side view of the device 50 vertically inserted into a typical unit 48 of the type handled by the lifting device of the present invention.

In accordance with the invention, bar 42 provides a fulcrum point for legs 33 and 34 to pivot on pins 38 and 39 permitting a lever function.

Sheaves 29 and 30 mounted on pins 36 and 37 provide for cable 26 to smoothly actuate lever function when upward force is applied to attachment 22.

Bar 42 extending beyond legs, 33 and 34 enables the device to rest at a standard elevation for engagement with unit 48. Hook 20 and unit 48 shown to illustrate their role.

Figure 8:
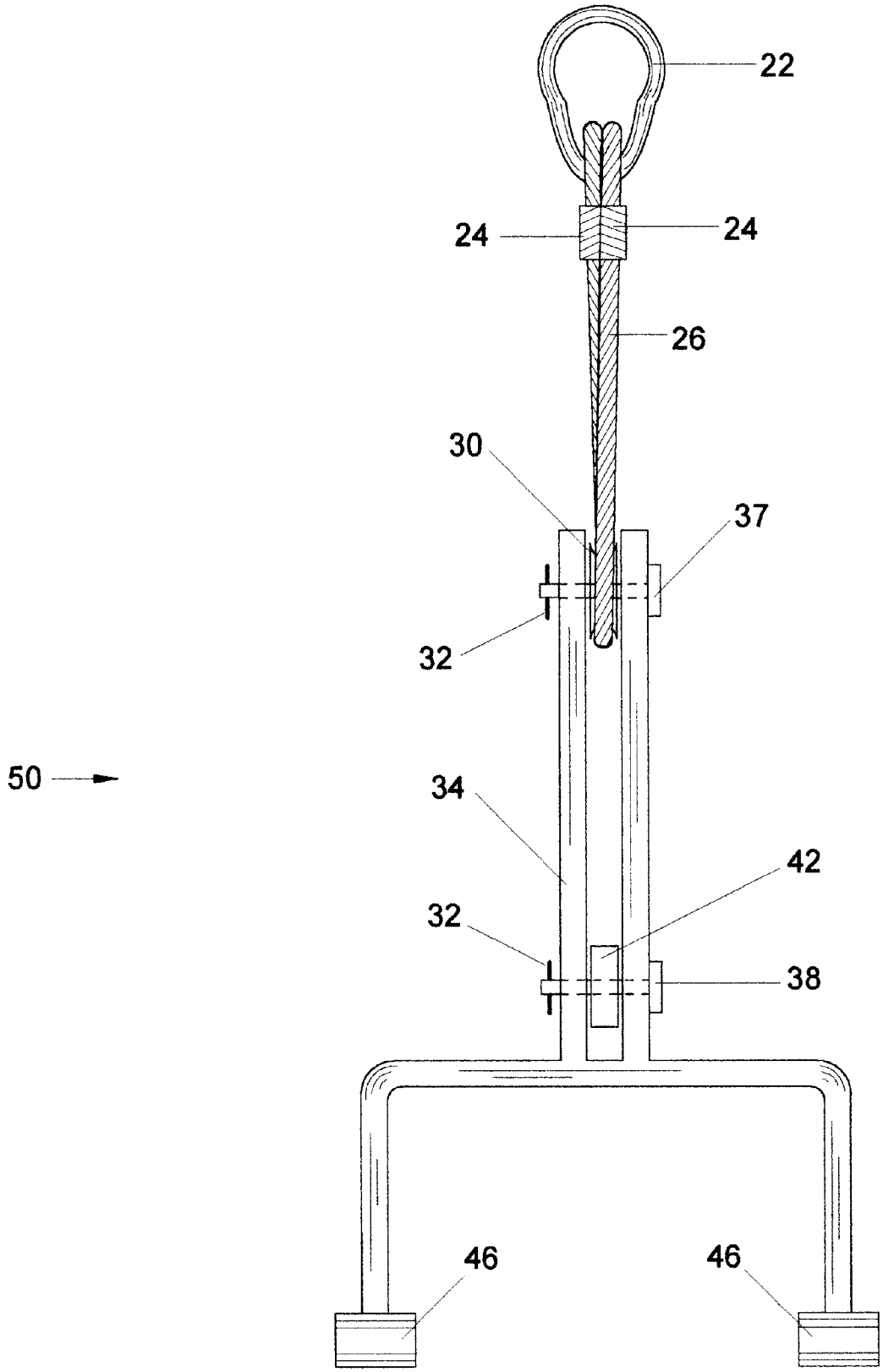
FIG. 8 Shows a right end view of the lifting device of the present invention 50. You can easily see the position of sheave 30, adjustable spreader bar 42, and shoes 46, note: lifting hook 20, cable guide 44, and box 48, not shown.

FIG. 8 clearly defines the position of the shoes 46 respectively with bar 42 sheave 30 pins 37, 38 and clips 32. Pins 38 and 39 connect fulcrum point of bar 42 (With clips 32) to legs 33 and 34, below a immediate point to provide a greater distance from the sheaves 29 and 30, then from shoes 46. Thus achieving a strong grip on unit 48.

Figure 9:
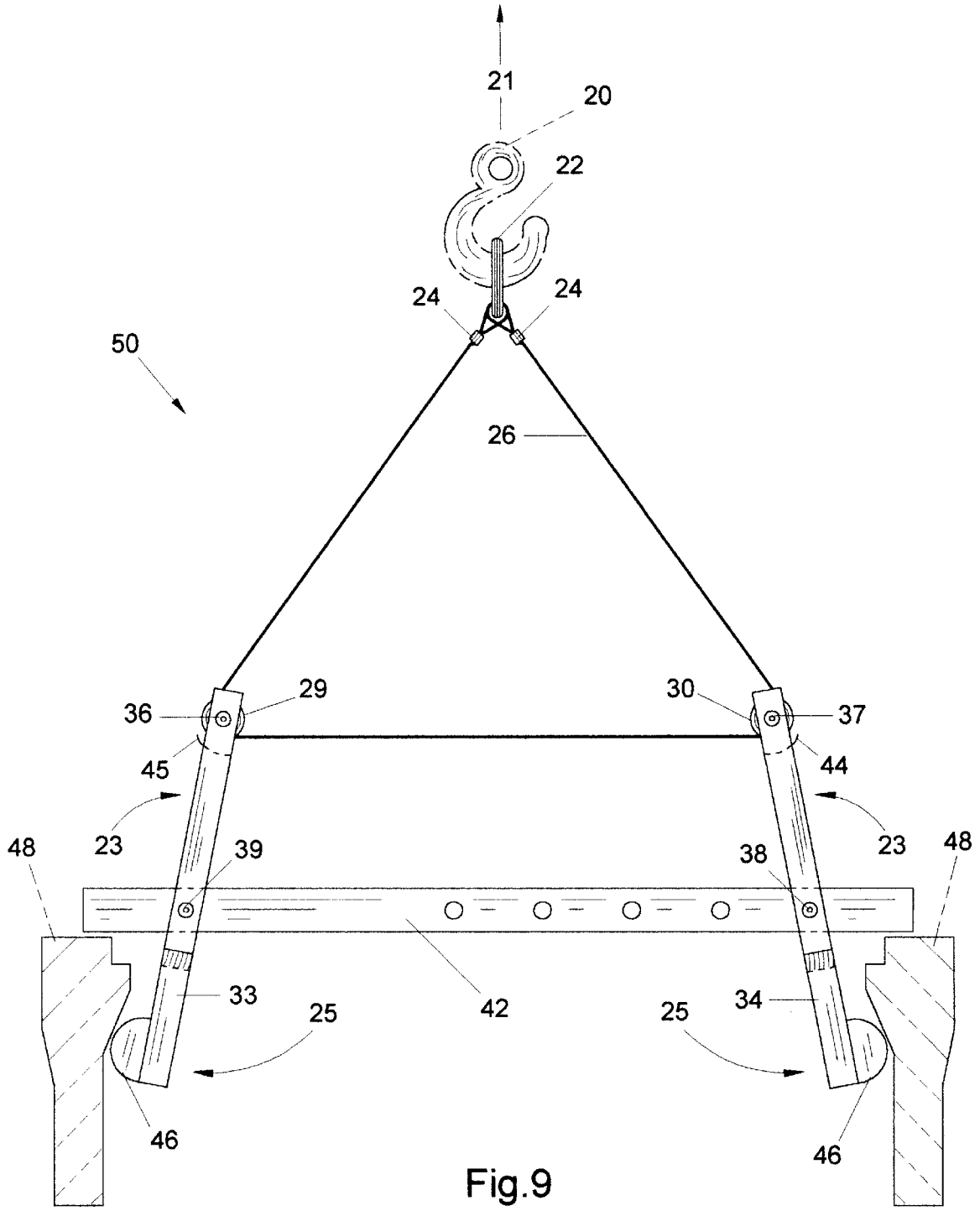
FIG. 9 Is a side view of the lifting device of the present invention 50 being shown in engagement with, and supporting a utility vault box unit 48.

When attachment 22 is pulled upwardly as illustrated at 21 in FIG. 9, legs 33 and 34 pivot inwardly 23 at upper end portions and outwardly 25 at lower end portions with the urging of cable 26 to sheaves 29 and 30.

This causes the device to assume its expanded position with its shoes 46 in engagement with the internal side surfaces of unit 48.

That is, the geometrical configuration of the legs and the various links is such as to cause the legs to assume the FIG. 9 position. Thus, any upwardly exerted force on attachment 22 is exerted literally through the links and the legs to the lowermost portion of the legs therefrom and forming a continuation or an apex of a general A-shape configuration.

The engagement of the lifting device 50 with unit 48 for lifting and manipulating is provided for by a pair of shoes 46 mounted respectively at lower end portions of the legs as a best shown in FIG. 9.

The shoes 46 have opposing laterally outward projecting portions.

Mounted in pairs in a horizontal position they engage the internal side surfaces of unit 48.

Further embodiments will include other variations of shoe design such as bolt-on and pivotal shoes, including shoes of varying length and shape that will be desirable to handle other structures of varying geometric configuration.

Figure 10:
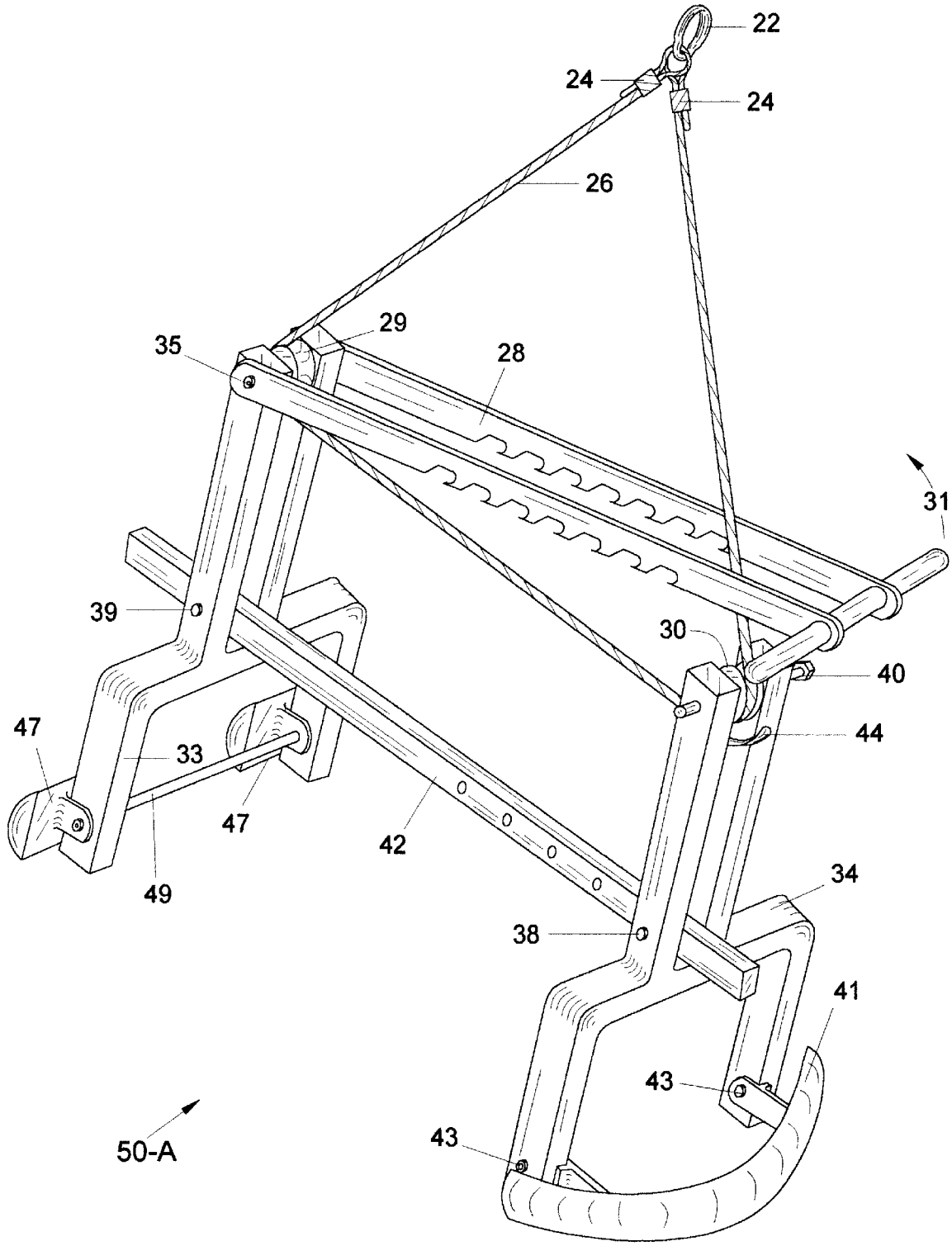
FIG. 10 Shows a perspective view of the lifting device of the present invention 50-A with optional locking arm 28, long pin 35, and "special pin-bold" 40.

A prospective view of a lifting device 50-A shown in FIG. 10 forms an additional embodiment of the present invention and may be substantially identical with the lifting device 50 described above. Except a locking mechanism is provided, with locking arm 28 long pin 35 and "special pin-bolt" 40.

That is, the device 50 can include an optional locking mechanism pivotally connected to the upper portion of leg 33 with pin 35.

Arm 28 locks onto "special pin-bold" 40 mounted to leg 34 when the device 50-A is in the engaged position, as will be shown in FIG. 14.

Locking arm in FIG. 10 is provided with a handle for ease of operation and shown raised at 31, as the lifting device is of course in its retracted position during free vertical movement between the walls of unit 48.

FIG. 10 also shows some examples of the typical bolt-on 41, and pivotal 47 shoes that can be adapted for different lifting applications.

FIG. 11 provides a side view of the device 50-A with locking arm 28 pivotally connected and in its raised position 31 vertically inserted in a typical unit 48 of the type handled by the lifting device of the present invention. Hook 20 and unit 48 shown to illustrate their role.

FIG. 12 showing an end view of the device 50-A with arm 28 clearly defines the roll of "special pin-bolt" 40.

As that it provides an extended area of pin surface projecting outwardly from upper portion of leg 34 providing a type of connecting link for arm 28 and a support for sheave 30.

While FIG. 13 shows a type of attachment used to secure the link.

As mentioned, FIG. 14 shows arm 28 in a locked position as the device of the present invention 50-A is in engagement with and supporting unit 48.

At this point once the shoes 46 are engaged with the internal side walls of unit 48 as shown in FIG. 14, and upward force 21 is exerted at the lifting attachment 22, the legs and their connecting links will remain in linear relationship 23 and 25 due to the linear forces exerted thereon.

Locking arm 28 may be unnecessary at this phase of operation, but will become apparent in the embodiment of operation.

FIG. 15 and 16, showing a side and top view of locking arm 28, while FIG. 17 and 18, shows a side and end view of "special pin-bolt" 40.

DETAILED OPERATION OF THE INVENTION—FIGS. 1 TO 14

Operation and use of the device of the present invention is simple and straightforward with reference to FIGS. 1 and 2 The Boxer 50 uses the simple principal of the lever.

With adjustable spreader bar 42 acting as the fulcrum and lifting legs 33 and 34 as the lever arms, they comprise the main embodiment of operation.

Legs 33 and 34 are oppositely connected to each other below an immediate point on bar 42 by pins 38 and 39, which allows legs 33 and 34 to pivot independently of each other on bar 42.

Bar 42 allows the distance to which legs 33 and 34 pivot from each other to be adjustable, by a series of holds in bar 42.

By removing pin 38 (held by keeper clip 32) from leg 34 and relocating that leg to a more desirable distance The Boxer 50 can be made to accommodate a wide variety of box sizes. (One typical utility vault box unit 48 is shown in FIGS. 3, 4, 5 and 6).

The placement of The Boxer 50 is as shown in FIG. 7, bar 42 extending outwardly beyond legs 34 enables the device to rest at a standard elevation for engagement.

Engagement with vault box 48 is assisted by shoes 46 as shown in FIG. 7, 8 and 9.

With FIG. 9 showing the actual movement of the lifting legs at 23 and 25 when upward force is applied to lifting attachment 22 as shown at 21 in FIG. 9 by hook 20.

Which may depend on a truck mounted crane.

The lifting legs 33 and 34 operate their function by cable 26 that is connected to the uppermost portions of legs 33 and 34 by a set of sheaves 29 and 30, cable is retained in position by cable guides 44 and 45, the cable then unites to attachment 22 with cable clamps 24 forming a triangular configuration.

When upward force 21 is applied to attachment 22, the uppermost portions of legs 33 and 34 swing inwardly at 23 and the lowermost portions swing outwardly at 25 to engage the internal side surfaces of the box 48 as showed in FIG. 9, thus supporting a utility vault box unit 48 and completing the operation.

A lifting device shown at 50-A in FIG. 10 forms a second embodiment of the present invention and may be substantially identical with lifting device 50 described above except a locking mechanism is adapted.

With locking arm 28 long pin 35 and "special pin-bolt" 40.

FIG. 10 also shows some examples of the typical bolt-on 41, and pivotal 47 shoes that can be adapted for different lifting applications.

FIG. 11, 12, and 13 illustrates arm 28 pivotally connected to leg 33 with pin 35 and locks onto leg 34 with "special pin-bolt" 40, this allows The Boxer 50-A as shown in FIG. 14 to be inserted in place and locked into the engaged position prior to upward force being applied to attachment 22.

Locking arm 28 serves it's intended purpose if box 48 is being suspended by The Boxer 50-A with a truck mounted crane, should the driver then operate the vehicle in a unsafe manner causing The Boxer 50-A with box 48 suspended, to obtain a moment of zero gravity The Boxer 50-A would remain securely attached to box 48.

OTHER EMBODIMENTS

LOCKING MECHANISM—DESCRIPTION

The lifting device 50 can include a optional locking mechanism 28 pivotally connected to the upper portion of lifting leg 33 with long pin 35 and locking onto "special pin-bolt" 40 mounted to lifting leg 34 when the device is in the engaged position as shown at 50-A in FIG. 14.

Locking mechanism shown at 28 in FIGS. 15 and 16 includes two parallel beams that straddle the outside portion of lifting legs 33 and 34, at shown at 50-A in FIG. 10. Bottom side of locking mechanism 28 has a series of locking notches as shown at 28 in FIG. 15 to engage and lock onto "special pin-bolt" 40 FIG. 17.

LOCKING MECHANISM—OPERATION

The operation of the locking mechanism allows "The Boxer" 50-A to be inserted in place and locked into the engaged position prior to upward force 21 being applied to attachment 22 as shown in FIG. 11, 12, 13, and 14.

Locking mechanism 28 serves it's intended purpose if box 48 is being suspended by The Boxer 50-A with a truck mounted crane, should the driver that operate the vehicle in a unsafe manner causing The Boxer 50-A with box 48 suspended, to obtain a moment of zero gravity The Boxer 50-A would remain securely attached to box 48.

BOLT-ON AND PIVOTING SHOES—DESCRIPTION

These shoes are adapted to bolt-on to the lowermost portions of lifting legs 33 and 34, and they may use a variety of materials such as furious or non-furious to rubber, accommodating a multitude of lifting applications.

They can be adapted as single shoes, or one-piece shoes extending horizontal across the lowermost portion of lifting arm 34, and be supplied in a multitude of shapes, all of which type may also pivot on lifting legs 33 and 34 by replacing bolt fasteners with pivot pins 49.

BOLT-ON AND PIVOTING SHOES—OPERATION

Lowermost portion of lifting legs 33 and 34 are drilled with mounting holes for accommodating bolt-on or pivoting shoes.

Bolt-on and pivoting shoes have a drilled support mounted perpendicular to ifs backing for connecting to legs 33 and 34 with a common bolt fastener 43.

An elongated pivot pin 49 running horizontally across the full path of lifting legs 33 and 34 allows the shoes to pivot The distance from the shoe's backing plate to the lifting leg determines pivot radius.

CONCLUSIONS, RAMIFICATIONS, AND SCOPE

It will be apparent that a novel lifting device has been provided in accordance with the present invention.

The device is particularly adapted for efficient use with precast concrete utility vault box units of the type described, and provides for a rapid and efficient operation in the lifting and manipulating of the vault units.

The device is yet simple in concept and construction and exhibits a high degree of durability and dependability in use.

While the above description contains many specificities, these should not be construed as limitations on the scope of the invention, but as exemplifications of the presently preferred embodiments thereof.

Many other ramifications and variations are possible within the teachings of the invention.

For example, The Boxer 50 and 50-A can be made from a wide variety of materials in various configurations or scale to accommodate load capacities or industrially needs such as, a fixed and/or double spreader bar with only one lifting leg pivotally connected are some of the possibilities capable from this lifting device.

Accordingly, it can be seen that The Boxer 50 and 50-A provides a safe and easy way to manipulate heavy precast concrete utility vault boxes of all types, reducing injuries, and increasing productivity and safety in the workplace.

The Boxer 50 and 50-A is lightweight simple and easy to use.

With economy trends towards a more ergonomically user friendly work environment, The Boxer 50 and 50-A addresses the need for a safer and more productive technique for handling these heavy precast concrete utility vault boxes. Thus, the scope of the invention should be determined by the appended claims and their legal equivalents, rather than by the examples given.

I claim:

1. A device for lifting and manipulating precast concrete utility vault box units having a multitude of forms by attaching itself internally to said units, comprising: a pair of lifting legs that are forked, at least one spreader element that is elongated, said lifting legs being joined perpendicular to said spreader element at an intermediate point on said legs whereby at least one of the legs is pivotally moveable, wherein said spreader element is in-between said legs, and said legs are pivotally attached to said spreader element to provide movement between their retracted and expanded position, said legs having means for attaching at their upper ends to a vertically movable hoist to provide the pivotal movement at the urging of said hoist to at least one leg on said spreader element, whereby said legs are forked at their lowermost ends providing a means of supporting shoes for engaging said units.

2. A device for lifting and manipulating precast concrete utility vault box units as set forth in claim 1 wherein said means for attaching comprises a pair of sheaves mounted to the upper ends of the legs to aid a single flexible cable engaged to said sheaves with ends coupled to a lifting attachment subsequently forming a triangular configuration.

3. A device for lifting and manipulating precast concrete utility vault box units as set forth in claim 1 wherein said lifting legs being attached at spaced locations on said spreader element such that said legs can freely pass vertically between the sides of said vault box unit respectively in close proximity to the inner walls of said unit.

4. A device for lifting and manipulating precast concrete utility vault box units as set forth in claim 1 wherein at least one pair of said shoes are respectively mountable on lowermost portions of said lifting legs and having opposing lateral outward projecting portions adapted respectively to engage internal side surfaces of said vault box units with the legs of the lifting device in the expanded position.

5. A device for lifting and manipulating precast concrete utility vault box units as set forth in claim 1 further including a spreader element that provides horizontal adjustability through a plurality of perpendicular holes.

6. A device for lifting and manipulating precast concrete utility vault box units as set forth in claim 1 further including a manually locking mechanism for securing said legs in their retracted or expanded positions.

7. A device for lifting and manipulating precast concrete utility vault box units as set forth in claim 1 wherein said legs assume approximately a parallel relationship in their retracted position.

8. A device for lifting and manipulating precast concrete utility vault box units as set forth in claim 1 wherein said shoes are adapted to bolt-on to the lowermost portions of said legs.

9. A device for lifting and manipulating precast concrete utility vault box units as set forth in claim 1 wherein said shoes are pivotally mounted on lowermost portions of said legs.

10. A device for lifting and manipulating precast concrete utility vault box units as set forth in claim 1 wherein said shoes are tailored to accommodate various lifting requirements, said shoes being selectively mountable on said legs.

11. A lifting device for providing a means to lift and manipulate concrete utility vault box units comprising: at least one longitudinal spreader element, two opposing lifting members in forked form and a single flexible line for attaching upper ends of said lifting members to a vertically movable hoist, said spreader element being pivotally connected to said lifting members subsequently forming an H-shape configuration, said flexible line being connected with upper ends of said lifting members and to said hoist wherein said line is taking a three point form at the apex of said H-shape configuration, whereby said legs lifting members are forked at their lowermost ends providing a means of engagement with said units at the lowermost ends of said lifting members.

12. A device for providing a means to lift and manipulate concrete utility vault box units as set forth in claim 11 wherein said spreader element is horizontally adjustable throughout.

13. A device for providing a means to lift and manipulate concrete utility vault box units as set forth in claim 11 wherein at least one of said lifting members is pivotally connected.

14. A device for providing a means to lift and manipulate concrete utility vault box units as set forth in claim 11 further including sheaves mounted to upper ends of said lifting members to aid said flexible line.

15. A device for providing a means to lift and manipulate concrete utility vault box units as set forth in claim 11 further including shoes mountable to said lifting members for various lifting applications.

16. A device for providing a means to lift and manipulate concrete utility vault box units as set forth in claim 11 further including a lifting attachment for joining said line to said hoist.

17. A device for lifting and manipulating precast concrete utility vault box units as set forth in claim 11 further including a locking mechanism for securing said lifting members in their retracted or expanded positions.

* * * * *